US009523291B2

(12) United States Patent
Coffey et al.

(10) Patent No.: US 9,523,291 B2
(45) Date of Patent: Dec. 20, 2016

(54) VALVE ACTUATION SYSTEM HAVING ROCKER-LOCATED HYDRAULIC RESERVOIR

(71) Applicant: Caterpillar Inc., Peoria, IL (US)

(72) Inventors: Charles F. Coffey, Peoria, IL (US); Edwin H. Langewisch, Dunlap, IL (US); Ashwin A. Hattiangadi, Edwards, IL (US); David A. Cyborski, Peoria, IL (US); John S. Pipis, Jr., Washington, IL (US); Kevin D. Yoder, Peoria Heights, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/661,900

(22) Filed: Mar. 18, 2015

(65) Prior Publication Data

US 2016/0273416 A1 Sep. 22, 2016

(51) Int. Cl.

| | |
|---|---|
| ***F01L 1/24*** | (2006.01) |
| ***F01L 1/047*** | (2006.01) |
| ***F01L 1/18*** | (2006.01) |
| *F01L 1/26* | (2006.01) |

(52) U.S. Cl.

CPC ..... *F01L 1/2411* (2013.01); *F01L 1/047* (2013.01); *F01L 1/181* (2013.01); *F01L 1/267* (2013.01); *F01L 2001/2433* (2013.01); *F01L 2001/2444* (2013.01)

(58) Field of Classification Search

CPC .. F01L 1/2411; F01L 1/267; F01L 2001/2433; F01L 2001/2444

USPC ..... 123/90.25, 90.36, 90.4, 90.43, 90.44,123/90.46

See application file for complete search history.

(56) References Cited

U.S. PATENT DOCUMENTS

| | | | | |
|---|---|---|---|---|
| 2,380,051 | A * | 7/1945 | Kettering | F01L 1/181 123/90.4 |
| 4,644,914 | A | 2/1987 | Morita et al. | |
| 4,924,821 | A * | 5/1990 | Teerman | F01L 1/2411 123/90.22 |
| 5,890,469 | A | 4/1999 | Håkansson et al. | |
| 6,065,434 | A | 5/2000 | Schmidt | |
| 6,178,946 | B1 | 1/2001 | Matthews et al. | |
| 7,984,705 | B2 | 7/2011 | Yang | |

(Continued)

FOREIGN PATENT DOCUMENTS

| | | |
|---|---|---|
| EP | 1 022 444 | 7/2000 |
| WO | WO 2013/020358 | 2/2013 |
| WO | WO 2014/001560 | 1/2014 |

*Primary Examiner* — Jorge Leon, Jr.

(74) *Attorney, Agent, or Firm* — Finnegan, Henderson, Farabow, Garrett & Dunner, LLP

(57) ABSTRACT

A valve actuation system is disclosed for an engine. The system may have at least one gas exchange valve, a rocker shaft, a camshaft, a rocker arm connected to the rocker shaft and operatively engaged with the camshaft, a valve bridge engaged with the at least one gas exchanger valve, a lash adjuster disposed in the valve bridge, and a button configured to slide on the valve bridge. The system may further include a pin fluidly connecting the rocker arm to the button and having an elongated cylindrical shaft with a first open end inside the rocker arm and a second end inside the button. The pin may also have a head connected to and a reservoir formed in the elongated cylindrical shaft. The pin may further have passages extending from the bore of the rocker arm to the reservoir, and s passage extending from the reservoir through the head.

18 Claims, 3 Drawing Sheets

(56) References Cited

U.S. PATENT DOCUMENTS

| | | | | |
|---|---|---|---|---|
| 8,210,144 | B2 | 7/2012 | Langewisch | |
| 8,499,740 | B2 | 8/2013 | Yoon et al. | |
| 2005/0211206 | A1* | 9/2005 | Ruggiero | F01L 1/08 123/90.16 |
| 2009/0107428 | A1* | 4/2009 | Magnan | F01L 1/181 123/90.12 |
| 2010/0170471 | A1* | 7/2010 | Yang | F01L 1/08 123/321 |
| 2014/0083381 | A1* | 3/2014 | Roberts | F01L 1/08 123/90.15 |

* cited by examiner

VALVE ACTUATION SYSTEM HAVING ROCKER-LOCATED HYDRAULIC RESERVOIR

TECHNICAL FIELD

The present disclosure is directed to a valve actuation system and, more particularly, to a valve actuation system having a rocker-located lash reservoir.

BACKGROUND

Each cylinder of an internal combustion engine is equipped with one or more gas exchange valves (e.g., intake and exhaust valves) that are cyclically opened during normal operation. In a conventional engine, the valves are opened by way of a camshaft/rocker arm arrangement. The camshaft includes one or more lobes oriented at particular angles corresponding to desired lift timings and amounts of the associated valves. The cam lobes are connected to stem ends of the associated valves by way of the rocker arm and associated linkage components. As the camshaft rotates, the cam lobes come into contact with a first pivoting end of the rocker arm, thereby forcing a second pivoting end of the rocker arm against the stem ends of the valves. This pivoting motion causes the valves to lift or open against a spring bias. As the cam lobes rotate away from the rocker arm, the valves are released and allowed to return to their closed positions.

When a cylinder is equipped with more than one of the same type of gas exchange valve (e.g., more than one intake valve and/or more than one exhaust valve), all valves of the same type are typically opened at about the same time. And in order to reduce a number of camshafts, cam lobes, and/or rocker arms required to open the multiple valves, a valve bridge is often used to interconnect the same type of valves with a common rocker arm.

A valve bridge is generally T-shaped, having arms that extend between the stem ends of two like valves. The second end of the rocker arm engages a center portion of the valve bridge, between the arms. With this configuration, a single pivoting motion imparted to the center of the valve bridge by the rocker arm results in lifting of the paired valves by about the same amount and at about the same timing. A lash adjuster can be associated with the ends of each valve stem in the valve bridge and used to remove clearance that exists between the valves and corresponding seats (and/or between other valve train components) when the valve is released by the rocker arm. The lash adjuster helps to ensure sealing of the cylinder during the ensuing combustion process.

An exemplary valve actuation assembly is disclosed in U.S. Pat. No. 4,924,821 that issued to Teerman on May 15, 1990 ("the '821 patent"). The '821 patent discloses a system having hydraulic lash adjusters disposed within a valve bridge to engage stem ends of two associated exhaust valves. A screw actuator extends from a rocker arm into a socket recessed within a center of the valve bridge. Engine oil is fed through a gallery in the rocker arm, through the screw actuator, and through the valve bridge to the hydraulic lash adjusters.

Although the valve actuation assembly of the '821 patent may be suitable for many applications, it may still be less than optimal. For example, the engine oil is only fed to the lash adjusters as long as the associated engine is operational. During engine restart and before the oil can be pressurized and directed to the valve actuation assembly, there may not be enough oil in the valve actuation assembly to ensure proper operation of the assembly.

The valve actuation system of the present disclosure is directed towards overcoming one or more of the problems set forth above and/or other problems of the prior art.

SUMMARY

One aspect of the present disclosure is directed to a pin for use with a valve actuation system having a rocker arm. The pin may include an elongated cylindrical shaft having a first open end configured to be received within a bore of the rocker arm, and a second end. The pin may also include a head connected to the elongated cylindrical shaft at the second end and having a rounded outer surface, a reservoir formed in the elongated cylindrical shaft, and an axial passage extending from the reservoir through the head. The reservoir may have an inner diameter that is about 2-3 times an inner diameter of the axial passage.

Another aspect of the present disclosure is directed to another pin for use with a valve actuation system having a rocker arm. This pin may include an elongated cylindrical shaft having a first open end configured to be received within a bore of the rocker arm, and a second end. The pin may also include a head connected to the elongated cylindrical shaft at the second end and having a rounded outer surface, and a reservoir formed in the elongated cylindrical shaft. The pin may further include an axial passage extending from the reservoir through the head, and a plurality of radially oriented recesses formed at the first open end.

Yet another aspect of the present disclosure is directed to a valve actuation system. The valve actuation system may include at least one gas exchange valve; a rocker shaft; a camshaft; and a rocker arm pivotally connected to the rocker shaft and having a first end operatively engaged with the camshaft, a second end with a bore, and first passage extending from the rocker shaft to the bore. The valve actuation system may also include a valve bridge engaged with the at least one gas exchanger valve, at least one lash adjuster disposed in the valve bridge, and a button configured to slide on the valve bridge and having a second passage in fluid communication with the at least one lash adjuster. The valve actuation system may further include a pin fluidly connecting the rocker arm to the button. The pin may have an elongated cylindrical shaft with a first open end located inside the bore of the rocker arm in fluid communication with the first passage, and a second end located inside the button in fluid communication with the second passage. The pin may also have a head connected to the elongated cylindrical shaft at the second end, and a reservoir formed in the elongated cylindrical shaft. The pin may further have a plurality of radially oriented passages extending from the bore of the rocker arm to the reservoir, and an axial passage extending from the reservoir through the head.

DETAILED DESCRIPTION

Figure 1:
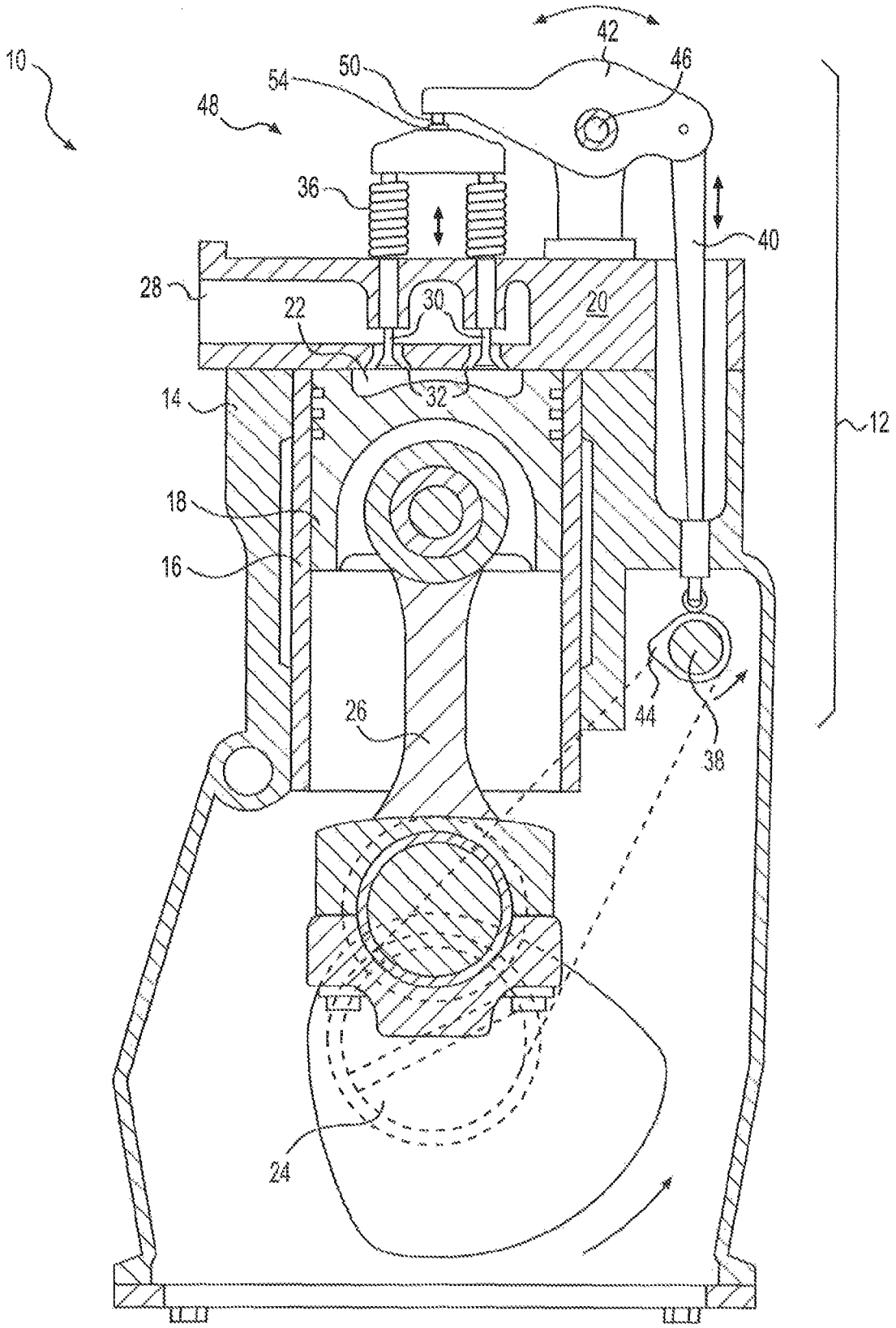
FIG. 1 is a diagrammatic illustration of an exemplary disclosed engine.

FIG. 1 illustrates an engine 10 equipped with an exemplary disclosed valve actuation system 12. For the purposes of this disclosure, engine 10 is depicted and described as a four stroke diesel engine. One skilled in the art will recognize, however, that engine 10 may embody any type of combustion engine such as, for example, a two- or four-stroke, gasoline or gaseous fuel-powered engine. As will be described in more detail below, valve actuation system 12 may help regulate fluid flows through engine 10.

Engine 10 may include an engine block 14 that at least partially defines one or more cylinders 16. A piston 18 and a cylinder head 20 may be associated with each cylinder 16 to form a combustion chamber 22. Specifically, piston 18 may be slidably disposed within each cylinder 16 to reciprocate between a top-dead-center (TDC) position and a bottom-dead-center (BDC) position, and cylinder head 20 may be positioned to cap off an end of cylinder 16, thereby forming combustion chamber 22. Engine 10 may include any number of combustion chambers 22 and combustion chambers 22 may be disposed in an "in-line" configuration, in a "V" configuration, in an opposing-piston configuration, or in any other suitable configuration.

Engine 10 may also include a crankshaft 24 rotatably disposed within engine block 14. A connecting rod 26 may connect each piston 18 to crankshaft 24 so that a sliding motion of piston 18 between the TDC and BDC positions within each respective cylinder 16 results in a rotation of crankshaft 24. Similarly, a rotation of crankshaft 24 may result in a sliding motion of piston 18 between the TDC and BDC positions. In a four-stroke engine, piston 18 may reciprocate between the TDC and BDC positions through an intake stroke, a compression stroke, a power stroke, and an exhaust stroke. In a two-stroke engine, piston 18 may reciprocate between the TDC and BDC positions through a power/exhaust/intake stroke and an intake/compression stroke.

Cylinder head 20 may define one or more fluid passages 28 associated with each combustion chamber 22 that are configured to direct gas (e.g., air and/or exhaust) or a mixture of gas and fluid (e.g., fuel) into or out of the associated chamber 22. In the disclosed embodiment, cylinder head 20 is shown as defining a single passage 28. Passage 28 may represent either an intake passage or an exhaust passage in this embodiment. It should be noted that, while only a single fluid passage 28 is shown, as many intake and/or exhaust passages may be provided within cylinder head 20 as desired. As an intake passage, passage 28 would be configured to deliver compressed air and/or an air and fuel mixture into a top end of combustion chamber 22. As an exhaust passage, passage 28 would be configured to direct exhaust and residual gases from the top end of combustion chamber 22 to the atmosphere. It is contemplated that, in some embodiments, only an exhaust passage may be formed within cylinder head 20 and the corresponding intake passage may instead be formed within engine block 14. In these configurations, the intake passage would be configured to direct air or the mixture of air and fuel radially inward to combustion chamber 22 through a side wall of cylinder 16.

A plurality of gas exchange valves 30 may be disposed within openings of passageway 28 and movable to selectively engage corresponding seats 32. Specifically, each valve 30 may be movable between a first position at which valve 30 is engaged with seat 32 to inhibit a flow of fluid through the opening, and a second position at which valve 30 is moved away from seat 32 (i.e., lifted) to allow a flow of fluid through the opening. The timing at which valve 30 is moved away from seat 32 (relative to a position of piston 18 between the MC and BDC positions), as well as a lift height of valve 30 at the particular timing, may have an effect on the operation of engine 10. For example, the timing and lift height may affect production of emissions, production of power, fuel consumption, efficiency, temperature, pressure, etc. A spring 36 may be associated with each valve 30 and configured to bias valve 30 toward the first position and against seat 32. A spring retainer, not shown, may connect spring 36 to a stem end of each valve 30.

Figure 3:
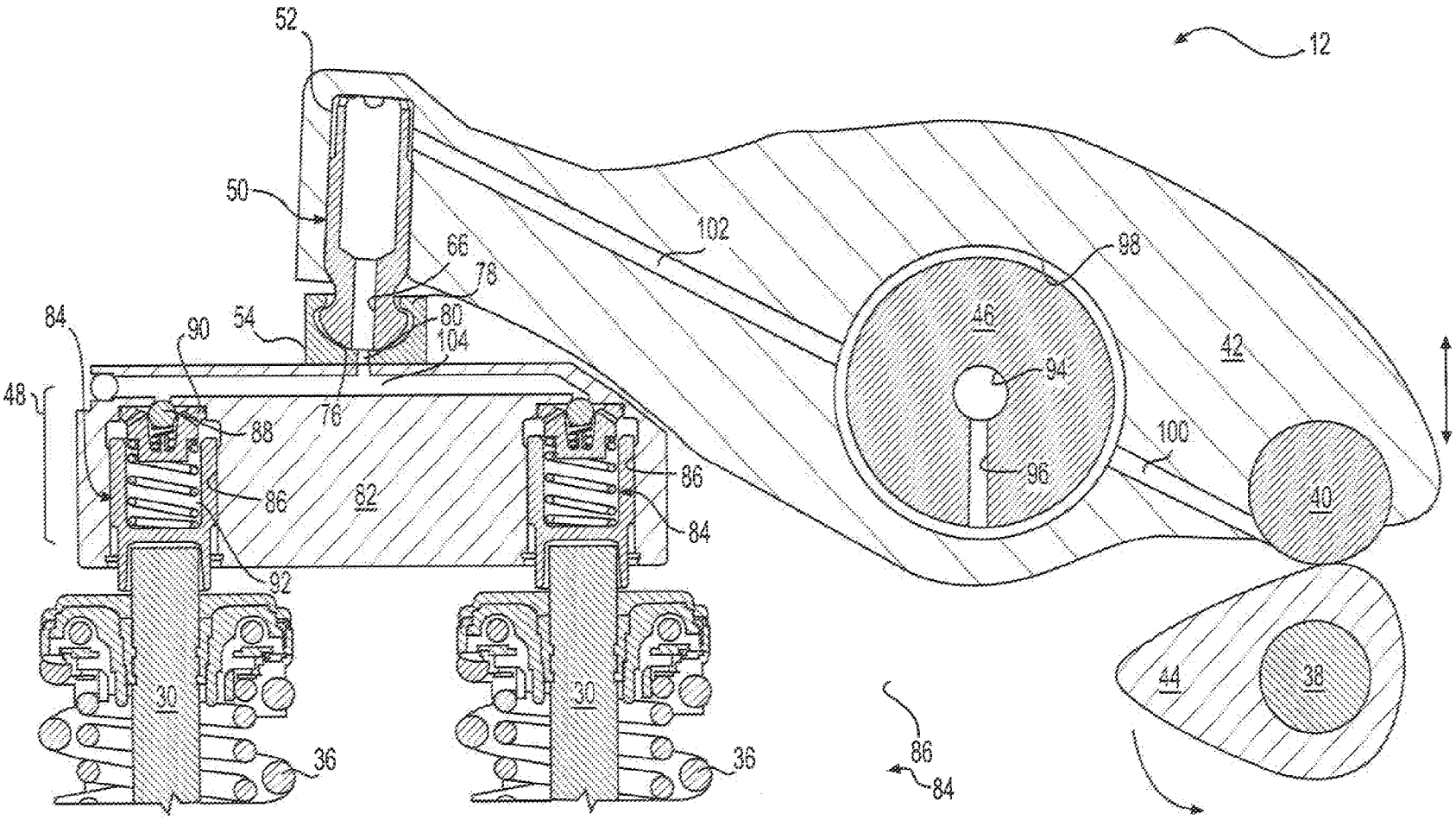
FIG. 3 is a cross-sectional illustration of an exemplary disclosed engine valve actuation system that may be used with the engine of FIG. 1 and that incorporates the rocker pin of FIG. 2.

Valve actuation system 12 may be operatively engaged with cylinder head 20 and configured to simultaneously move valves 30 against the biases of springs 36 from their first positions toward their second positions at desired timings. It should be noted that, when cylinder head 20 is provided with both intake and exhaust passages and corresponding intake and exhaust valves, engine 10 may include a separate valve actuation assembly for each set of intake and exhaust valves. Each valve actuation system 12 may include, among other things, a common camshaft 38, a dedicated cam follower arrangement (e.g., cam followers, push rods, etc.) 40, and a dedicated rocker arm 42. The valve actuation system 12 shown in FIG. 1 is an overhead valve pushrod-type of system, whereas the valve actuation system 12 shown in FIG. 3 is an overhead cam type of system. It should be noted that the disclosed concepts may be applicable to both of these types of systems, as well as other types of systems known in the art.

Camshaft 38 may operatively engage crankshaft 24 in any manner readily apparent to one skilled in the art, where a rotation of crankshaft 24 results in a corresponding rotation of camshaft 38. For example, camshaft 38 may connect to crankshaft 24 through a gear train (not shown) that decreases the rotational speed of camshaft 38 to approximately one half of the rotational speed of crankshaft 24 (in the exemplary 4-stroke arrangement). Alternatively, camshaft 38 may connect to crankshaft 24 through a chain, a belt, or in any other appropriate manner. At least one cam lobe 44 may be connected to camshaft 38 and associated with each pairing of valves 30. An outer profile of cam lobe 44 may determine, at least in part, the actuation timing and lift profile of valves 30 during operation of engine 10.

Cam follower arrangement 40 may ride on and move in accordance with the profile of cam lobe 44 as camshaft 38 rotates, and transfer a corresponding reciprocating motion to a first pivoting end of rocker arm 42. This reciprocating motion imparted to rocker arm 42 may cause rocker arm 42 to pivot about a shaft 46, thereby creating a corresponding reciprocating motion at an opposing second end of rocker arm 42 that lifts and releases valves 30. Thus, the rotation of camshaft 38 may cause valves 30 to move from the first position to the second position to create a specific lift pattern corresponding to the profile of cam lobe 44.

Rocker arm 42 may be connected to valves 30 by way of a valve bridge assembly 48. Specifically, rocker arm 42 may include a pin 50 that is received within a bore 52 (shown only in FIG. 2) at the second end of rocker arm 42, and a button 54 configured to receive an exposed end of pin 50. Button 54 may be able to swivel somewhat relative to pin 50, and include a generally flat bottom surface that is configured to slide along a corresponding planar upper surface of valve bridge assembly 48. The ability of button 54 to swivel and slide along the planar upper surface of valve bridge assembly 48 may allow rocker arm 42 to transmit primarily vertical (i.e., axia)) forces into valve bridge assembly 48. The only horizontal (i.e., transverse) forces transmitted between rocker arm 42 and valve bridge assembly 48 may be relatively low and due only to friction at the sliding interface between button 54 and bridge assembly 48. This interface may be lubricated and/or polished to reduce the associated friction.

Figure 2:
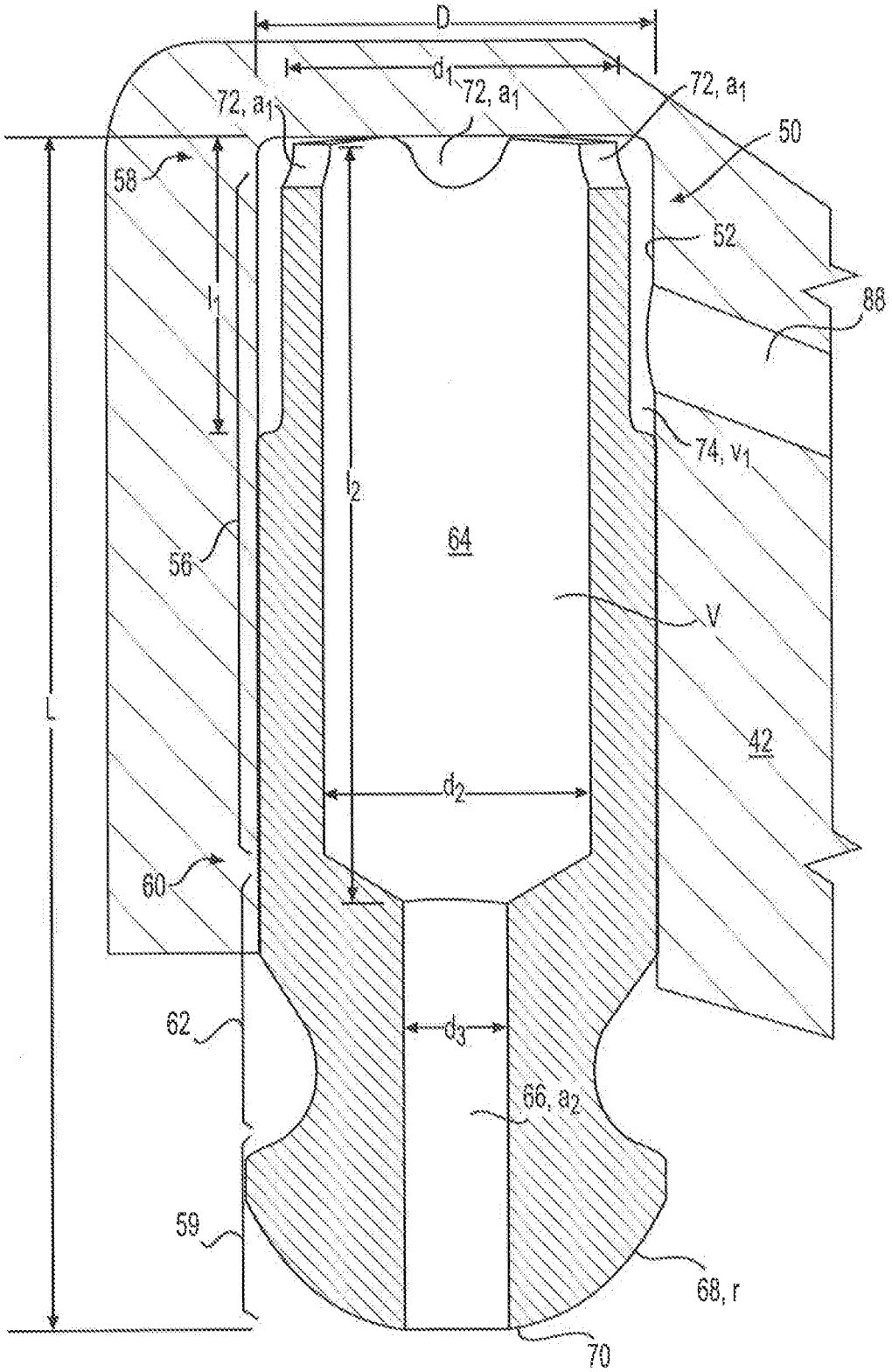
FIG. 2 is a cross-sectional illustration of an exemplary disclosed rocker pin.

An exemplary pin 50 is shown in FIG. 2. As can be seen in this figure, pin 50 may have generally cylindrical shaft 56 with a first end 58 and a second end 60. A rounded or tulip-shaped head 59 may be connected to second end 60 by way of a neck portion 62, and head 59 may protrude a distance from bore 52 of rocker arm 42 toward valve bridge assembly 48 (referring to FIG. 1). Shaft 56 may be hollow to form an internal reservoir 64 that is open at first end 58 to bore 52. A passage 66 may extend axially from reservoir 64 through a rounded outer surface 68 of head 59. The rounded shape of outer surface 68 may be truncated at a tip or center of head 59, such that a flat end face 70 is formed around an outlet of passage 66. Outer surface 68 may be received within a corresponding curved inner surface of button 54 (referring to FIG. 1), and flat end face 70, together with the curved inner surface of button 54, may form a hemispherical debris collection space. One or more (e.g., four) radial recesses 72 may be formed at first end 58, such that oil supplied to bore 52 may enter reservoir 64 via recesses 72 and the opening at first end 58.

In the disclosed embodiment, an outer cylindrical surface of shaft 56 is stepped. In particular, a diameter $d_1$ at first end 58 may be less than a diameter D at second end 60, such that an annular void or ring 74 is created within bore 52 at first end 58. As will be described in more detail below, ring 74 may function as a manifold, supplying oil to each of recesses 72. A volume $v_1$ of ring 74 may be related to a volume V of reservoir 64 in order to help ensure that an adequate supply of oil is immediately available to reservoir 64 via recesses 72. In the disclosed embodiment, the volume v of ring 74 is about ¼-⅓ of the volume V of reservoir 64.

The geometry of pin 50 may be designed to provide for a desired performance of (e.g., for a desired oil flow rate and supply pressure to) valve bridge assembly 48 within a limited space inside engine 10. In the disclosed embodiment, the diameter $d_1$ may be about 0.8-0.9 times the diameter D, and an axial length $l_1$ of ring 74 may be about ⅓-¼ of an overall axial length L of pin 50. An axial length $l_2$ of reservoir 64 may be about equal to 2-3 times an internal diameter $d_2$, and about 0.5-0.75 times the overall axial length L of pin 50. Pin 50 may be designed to extend from bore 52 by about ⅓ of its overall axial length L. The internal diameter $d_2$ of reservoir 64 may be about 2-3 times an internal diameter $d_3$ of passage 66. A combined cross-sectional area $a_1$ of all recesses 72 may be about the same as or greater than a cross-sectional area $a_2$ of passage 66. It should be noted that the terms "about", "substantially", and "generally", when used in describing pin 50, should be interpreted as "within engineering tolerances" in all instances.

As shown in FIG. 3, button 54 may have a cup-shaped socket 76 configured to receive head 59 of pin 50, and an annular lip 78 located at an upper edge of socket 76. The inner surface of socket 76 may be curved to generally match an external curvature of surface 68, and an inner radius at lip 78 may be smaller than the radius r of head 59. With this configuration, pin 50 may be connected to button 54 via a snap-lock interface. In particular, the inner radius of lip 78 may expand slightly as head 59 of pin 50 is forced into socket 76, and then contract back to its original dimension around neck portion 62 of pin 50 after head 59 is inside socket 76 to thereby lock pin 50 and button 54 together. An axial passage 80 may be formed at a bottom of socket 76 that is configured to communicate oil from passage 66 of pin 50 with valve bridge assembly 48.

As can also be seen in FIG. 3, valve actuation system 12 may include, among other things, a valve bridge 82, and one or more lash adjusters 84 disposed with valve bridge 82. As will be described in more detail below, each lash adjuster 84 may be configured to adjust a clearance between a corresponding valve 30 and its associated seat 32 (and/or between other valve train components) when cam lobe 44 is rotated away from cam follower arrangement 40.

Valve bridge ("bridge") 82 may, have a generally rectangular body, with lateral extensions protruding radially outward from opposing sides. An upper surface of bridge 82 (i.e., the surface oriented against rocker arm 42) may slope downward toward the lateral extensions in order to provide clearance for rocker arm 42. In contrast, a lower surface of bridge 82 may be generally flat. A bore 86 may be formed in each lateral extension of bridge 82 to accept lash adjusters 84.

Each lash adjuster 84 may embody any conventional type of adjuster that is configured to fill with oil as rocker arm 42 rotates away from valves 30, and then to internally trap the oil and function as a hydraulic link between rocker arm 42 and valves 30 as rocker arm 42 rotates back toward valves 30. In the disclosed embodiment, each lash adjuster 84 is a check-valve type of adjuster having a valve element 88 that is spring-biased against a seat 90. Valve element 88 may be pushed away from seat 90 during the retracting rocker arm movement to fill an associated hydraulic chamber 92 with oil, and re-engage seat 90 during extending rocker arm movement to lock the oil inside hydraulic chamber 92. It is contemplated that lash adjuster 84 may have another form, if desired.

The oil directed to lash adjusters 84 may be provided via bridge 82, button 54, pin 50, rocker arm 42, and rocker shaft 46. Specifically, the oil may be pressurized by an engine-driven pump (not shown) and directed into a centralized axial passage 94 of shaft 46. The oil may then be directed outward via one or more radial passages 96 to an annular groove 98 that surrounds shaft 46. From annular groove 98, the oil may be directed to the opposing first and second ends of rocker arm 42 via corresponding passages 100 and 102. The oil from passage 100 may lubricate cam follower arrangement 40, while the oil from passage 102 may be directed through pin 50 (e.g., through ring 74, recesses 72, reservoir 64, and passage 66—referring to FIG. 2) and button 54 (e.g., through passage 80) to bridge 82. One or more passages 104 inside bridge 82 may then direct the oil to bores 86 in which lash adjusters 84 are located.

INDUSTRIAL APPLICABILITY

The disclosed valve actuation system may have applicability with internal combustion engines. In particular, the disclosed valve actuation system may be used to lift one or more gas exchange valves of an engine, while maintaining a desired valve clearance from startup to shut down of the engine. For example, during engine operation, pressurized oil may be directed through shaft 46 and rocker arm 42 to fill ring 74 and reservoir 64. The pressurized oil may push on through passage 66 of pin 50, passage 80 of button 54, and passage 104 to lash adjusters 84, Lash adjusters 84 may use the oil, as necessary, to create a hydraulic link between rocker arm 42 and valves 30 that establishes a desired lift profile throughout the life of engine 10.

At engine startup and until a steady supply of oil can be established and directed to lash adjusters 84, the oil remaining inside reservoir 64 from a previous operation may be drawn down into (i.e., sufficient to gravity feed) lash adjusters 84, allowing lash adjusters 84 to function normally. In the disclosed embodiment, lash adjusters 84 may not always be completely empty at engine startup and, thus, may not require a supply of oil equal to their empty volumes. Instead, lash adjusters 84 may need only small amounts of makeup oil to replace what might have been splashed out during engine shutdown and/or that leaked out slowly over time after engine shutdown. Accordingly, reservoir 64 inside pin 50 may be configured to supply this makeup oil for the amount of time it takes for the associated pump to provide a fresh supply of pressurized oil after engine startup. In one example, the volume of oil retained inside reservoir 64 at engine shutdown may be about equal or greater than the volume of hydraulic chamber 92 inside both of lash adjusters 84 (i.e., all of the lash adjusters included within valve bridge assembly 48).

Because lash adjusters 84 may be provided with oil even after engine shut down and before fill operation of any associated pump, a longevity and performance of engine 10 may be preserved. In particular, lash adjusters 84 may be provided with enough oil to allow them to function normally, which may decrease engine noise, improve valve operation, and reduce wear during engine startup.

It will be apparent to those skilled in the art that various modifications and variations can be made to the valve actuation system of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A pin for a valve actuation system having a rocker arm, comprising:

an elongated cylindrical shaft having a first open end, a second end, and an outer surface, wherein the first open end is configured to be received within a bore of the rocker arm, wherein the outer surface is stepped, wherein a first outer diameter at the first open end is smaller than a second outer diameter at the second end, and wherein at least one radially oriented recess is formed at the first open end;

a head connected to the elongated cylindrical shaft at the second end and having a rounded outer surface;

a reservoir formed in the elongated cylindrical shaft; and an axial passage extending from the reservoir through the head, wherein the reservoir has an inner diameter that is about 2-3 times an inner diameter of the axial passage.

2. The pin of claim 1, wherein the first outer diameter is about 0.8-0.9 times the second outer diameter.

3. The pin of claim 1, wherein a volume at the first open end formed by a difference in the first and second outer diameters inside the bore of the rocker arm is about ¼-⅓ of a volume of the reservoir.

4. The pin of claim 3, wherein an axial length of the outer surface having the first outer diameter is about ⅓-¼ of an overall axial length of the pin.

5. The pin of claim 1, wherein an axial length of the reservoir is about 2-3 times an internal diameter of the reservoir.

6. The pin of claim 5, wherein the axial length of the reservoir is about 0.5-0.75 times an overall axial length of the pin.

7. The pin of claim 1, wherein the rounded outer surface is truncated at a center to form a flat end face.

8. The pin of claim 1, wherein the at least one radially oriented recess includes a plurality of radially oriented recesses.

9. The pin of claim 8, wherein a combined cross-sectional area of the plurality of radially oriented recesses is about the same as or greater than a cross-sectional area of the axial passage.

10. A pin for a valve actuation system having a rocker arm, comprising:

an elongated cylindrical shaft having a first open end, a second end, and an outer surface, wherein the first open end is configured to be received within a bore of the rocker arm, wherein the outer surface is stepped, wherein a first outer diameter at the first open end is smaller than a second outer diameter at the second end;

a head connected to the elongated cylindrical shaft at the second end and having a rounded outer surface;

a reservoir formed in the elongated cylindrical shaft;

an axial passage extending from the reservoir through the head; and a plurality of radially oriented recesses formed at the first open end.

11. The pin of claim 10, wherein a volume is formed inside the bore at the first open end by a difference in the first and second outer diameters and the volume is in fluid communication with the plurality of radially oriented recesses.

12. The pin of claim 10, wherein the first outer diameter is about 0.8-0.9 times the second outer diameter;

an axial length of the outer surface having the first outer diameter is about ⅓-¼ of an overall axial length the pin; and the volume is about ¼-⅓ of a volume of the reservoir.

13. The pin of claim 10, wherein an axial length of the reservoir is about 2-3 times an internal diameter of the reservoir; and the axial length of the reservoir is about 0.5-0.75 times an overall axial length of the pin.

14. The pin of claim 10, wherein the rounded outer surface is truncated at a center to form a flat end face.

15. The pin of claim 10, wherein a combined cross-sectional area of the plurality of radially oriented recesses is about the same as or greater than a cross-sectional area of the axial passage.

16. A valve actuation system for an engine, comprising:

at least one gas exchange valve;

a rocker shaft;

a camshaft;

a rocker arm pivotally connected to the rocker shaft and having a first end operatively engaged with the camshaft, a second end with a bore, and a first passage extending from the rocker shaft to the bore;

a valve bridge engaged with the at least one gas exchange valve;

at least one lash adjuster disposed in the valve bridge;

a button configured to slide on the valve bridge and having a second passage in fluid communication with the at least one lash adjuster; and a pin fluidly connecting the rocker arm to the button, the pin including:

an elongated cylindrical shaft having a first open end located inside the bore of the rocker arm in fluid communication with the first passage, and a second end located inside the button in fluid communication with the second passage, and an outer surface, wherein the outer surface is stepped, and wherein a first outer diameter at the first open end is smaller than a second outer diameter at the second end;

a head connected to the elongated cylindrical shaft at the second end;

a reservoir formed in the elongated cylindrical shaft;

a plurality of radially oriented recesses extending from the bore of the rocker arm to the reservoir; and an axial passage extending from the reservoir through the head.

17. The valve actuation system of claim 16, wherein the reservoir has a volume sufficient to gravity feed the at least one lash adjuster with fluid during startup of the engine until a steady supply of fluid is established.

18. The valve actuation system of claim 16, wherein the at least one lash adjuster includes two lash adjusters; and the reservoir has a volume about equal to or greater than a hydraulic chamber volume of both of the two lash adjusters.

* * * * *